US007893799B1

(12) United States Patent
Slicker et al.

(10) Patent No.: US 7,893,799 B1
(45) Date of Patent: Feb. 22, 2011

(54) MEMS LATCHING HIGH POWER SWITCH

(75) Inventors: James M. Slicker, West Bloomfield, MI (US); Gondi Kondaiah Ananthasuresh, Bangalore (IN)

(73) Assignee: Microstar Technologies, LLC, West Bloomfield, MI (US)

( * ) Notice: Subject to any disclaimer, the term of this patent is extended or adjusted under 35 U.S.C. 154(b) by 210 days.

(21) Appl. No.: 12/101,659

(22) Filed: Apr. 11, 2008

Related U.S. Application Data

(60) Provisional application No. 60/911,088, filed on Apr. 11, 2007, provisional application No. 60/917,132, filed on May 10, 2007.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,806,152 A 9/1998 Saitou et al.
5,909,078 A 6/1999 Wood et al.
6,020,564 A * 2/2000 Wang et al. ..... 200/181
6,321,654 B1 * 11/2001 Robinson ..... 102/251
6,672,795 B1 * 1/2004 Ellis et al. ..... 403/327
6,734,597 B1 5/2004 Howell et al.
7,051,656 B1 * 5/2006 Koehler et al. ..... 102/249
7,148,436 B1 * 12/2006 Lee et al. ..... 200/61.48
2005/0183609 A1 * 8/2005 Greywall ..... 102/247

OTHER PUBLICATIONS

Timothy Moulton, and G.K. Anathasuresh; Micromechanical devices with embedded electro-thermal-compliant actuation; Elsevier, Sensors and actuators, A 90 (2001); pp. 38-48.

Ye Wang, Zhihong Li, Daniel T. McCormick, Norman C. Tien; Low-Voltage Lateral-Contact Microrelays for RF Applications; Fifteenth IEEE International Conference on MEMS, Jan. 20-24, 2002.

* cited by examiner

*Primary Examiner*—Anh T Mai
*Assistant Examiner*—Bernard Rojas
(74) *Attorney, Agent, or Firm*—Dykema Gossett PLLC

(57) ABSTRACT

A microelectromechanical (MEMS) switch includes a substrate, a force-activated latching mechanism, and a spring-loaded shuttle. The latching mechanism has a proximal end and a distal end. In an embodiment, the latching mechanism includes two flexible latch arms each fixed at or about a proximal end and having a free distal end, and a connector connecting the latch arms. The spring-loaded shuttle includes a shuttle portion including a portion configured for engaging portions of the latch arms. The shuttle portion further being configured to translate about the substrate. The latching mechanism and the shuttle may be configured to include an electrical contact layer such that when the latch arms are engaged with the shuttle portion, a closed electrical circuit can be formed.

17 Claims, 2 Drawing Sheets

MEMS LATCHING HIGH POWER SWITCH

CROSS-REFERENCE TO RELATED APPLICATION

This application claims the benefit of U.S. provisional application Nos. 60/911,088, filed Apr. 11, 2007, and 60/917,132, filed May 10, 2007, both of which are hereby incorporated by reference as though fully set forth herein.

TECHNICAL FIELD

This invention generally relates to microelectro-mechanical system (MEMS) devices, including a MEMS latch capable of exerting high force when in the latched state with application as a high power switch

BACKGROUND OF THE INVENTION

Microelectromechanical systems (MEMS) have recently been developed as alternatives for conventional electromechanical devices such as switches, actuators, valves and sensors. MEMS are commonly made up of components between 10 to 100 micrometers in size (i.e. 0.01 to 0.1 mm) and MEMS devices may range in size from a 20 micrometers (20 millionth of a meter) to a millimeter (thousandth of a meter). MEMS devices are potentially low cost devices, due to the use of microelectronic fabrication techniques. New functionality may also be provided because MEMS devices can be much smaller than conventional electromechanical devices.

U.S. Pat. No. 5,806,152 to Saitou and Jakiela, entitled "Compliant Latching Fastener" discloses a latching fastener having cocking and triggering mechanisms. The fastener has two flexible fastening latch arms each fixed at a proximal end of the arm and having a free distal end. The two arms are located relative to each other to cooperate in grasping a structure between them. A fastener cocking mechanism is connected to the fastening latch arms for retracting the distal ends of the arms when the cocking mechanism is activated, to thereby produce a latching gap between the distal ends of the arms. A trigger mechanism is located between the fastening latch arms such that a structure guided into the latching gap can actuate the trigger, for deactivating the cocking mechanism, which in turn results in closing together of the distal ends of the fastening latch arms, to grasp the structure between them and latch the structure to the fastener. The latching fastener can be fabricated of plastic or other compliant material and is particularly well suited for fabrication as a silicon micro-fastener for micro-scale applications.

Moulton and Ananthasuresh have reported in the publication "Micromechanical devices with embedded Electro-Thermal-Compliant (ETC) actuation" *Elsevier, Sensors and Actuators*, A 90 (2001) 38-48, a means to achieve high actuation force using a folded beam structure, consisting of a narrow and wide beam attached to each other at both ends and connected electrically in parallel. An electrical current is made to pass through the parallel connection of beams, the electrical current being shared by the narrow and wide beams causing a differential expansion of the beams. The electro-thermal actuation is capable of one hundred times the force of electrostatically actuated devices.

It is desirable to provide a latching mechanism that exhibits high contact force in the latched position suitable for application as a high power electric switch.

BRIEF SUMMARY OF THE INVENTION

An embodiment of the present invention provides a high power MEMS switch, which comprises a latching mechanism for grasping a shuttle connected or attached to a spring-loaded contact element. In an embodiment, the latch may be devoid of a trigger mechanism. The latch provides electrical contacts, which are spanned by the contact element when the latch has grasped the shuttle. In a latched position, a spring that is connected to the contact element can be compressed so that the full force of the spring may be exerted on the contacts. A second spring may be connected or attached to the shuttle for returning the shuttle back to an unlatched position upon release of the latching mechanism.

The contact element may require a force to push it into position in order to be grasped by the latching mechanism. This force may be provided, for example, by an (ETC) folded or parallel beam actuator similar to those reported by Moulton/Ananthasuresh. Other arrangements for providing the opposing forces are conceivable and are within the teachings and ambit of the present invention. Examples of such other arrangements include, without limitation, actuator designs utilizing magnetic, electromagnetic, thermo-pneumatic valve actuation, thermal bimorph actuation, piezoelectric actuation and electrostatic actuation. Although these arrangements are mentioned in detail, it is understood by those of ordinary skill in the art that numerous other arrangement may provide opposing forces and remain within the spirit and scope of the invention. The mechanism may also require a counter-force to unlatch the contact element when desired. The counter-force can be provided by any number of actuator types such as, but not limited to, those mentioned above. When in a latched position, power to the latching actuator can be removed, conserving energy.

Since all motion is in the plane of the substrate, all contact surfaces can be on the sidewalls of their corresponding contact elements. Exemplary forms of sidewall coating of the switching contacts may be found, for instance, in the publication "Low-Voltage Lateral-Contact Microrelays for RF Applications" Ye Wang, Zhihong LI, Daniel T. McCormick and Norman C. Tien, Fifteenth IEEE International Conference on MEMS, Jan. 20-24, 2002 Las Vegas. Other forms of the configuration of switching contacts may be found in U.S. patent application "MEMS Switch" Ser. No. 10/922,481 and in U.S. patent application "N-Pole Bi-stable MEMS Switch" Ser. No. 11/491,417.

According to teachings of an embodiment of the present invention, the inventive MEMS device includes: (1) a microelectronic substrate, (2) a latching device firmly connected or anchored to the substrate, and (3) a shuttle having a spring loaded contact element that spans contacts mounted on the substrate when in a latched position. The shuttle may be connected to a second spring, which connects to the substrate and returns the shuttle to the unlatched position upon release of the latch. The first spring may be fully compressed when the contact is latched so that the full force of the first spring can be exerted on the contact elements. In an embodiment, two ETC actuators are provided. One actuator may move the shuttle into latched position and the second actuator may release the latch. The latched position may correspond the switch being closed and unlatched position may correspond to the switch being opened.

DETAILED DESCRIPTION

Figure 1:
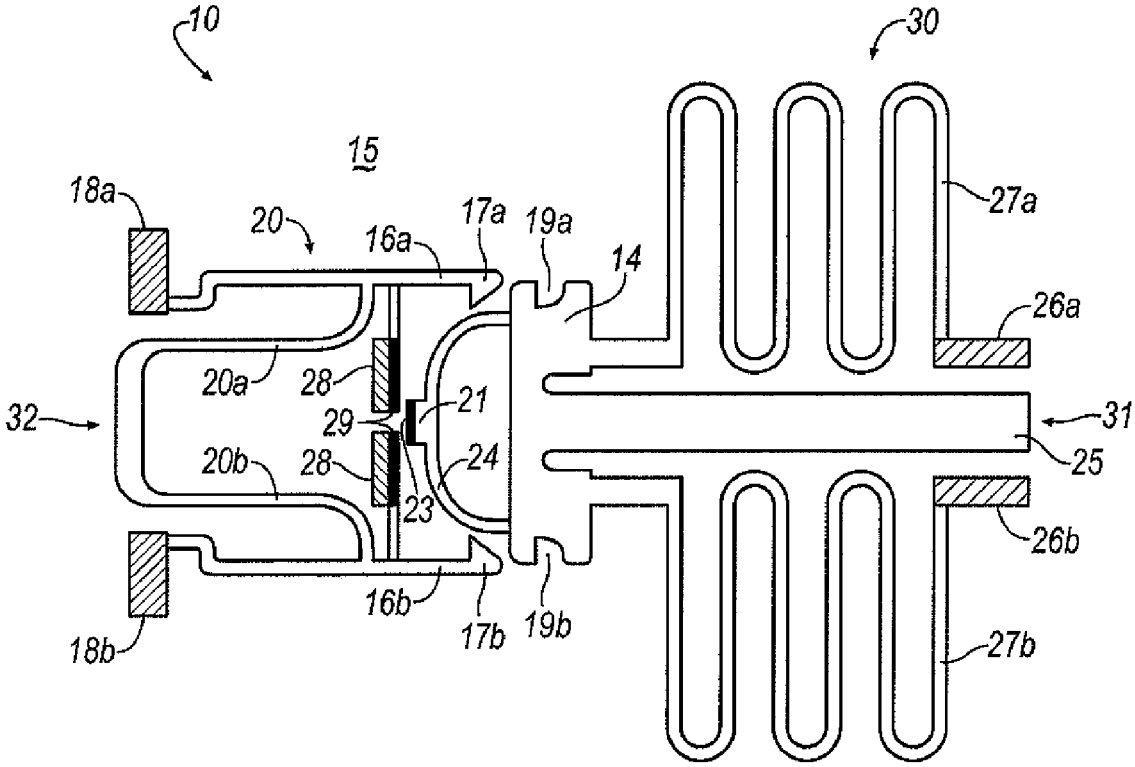
FIG. 1 shows a top-down view of a latching device in accordance with an embodiment of the invention.

The present invention now will be described hereinafter with reference to the accompanying drawing, in which an embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numerals refer to like elements throughout. Note the drawing is not to scale and the relative dimensions of each of the elements can be selected to give the desired motion.

Referring to FIG. 1, an embodiment of a MEMS switch 10 is shown, the switch 10 employs a planar fastener configuration. As such, the fastener provides a firmly connected or anchored planar latch 20 having compliant flexures for effecting cooperative fastening action between the latch 20 and a spring-loaded shuttle 30 including a shuttle portion 14 to be latched. The latch 20 may include fastening latch arms, here embodied as outer latching arms 16*a*, 16*b*, each connected to and/or anchored by corresponding anchors 18*a*, 18*b*, at or about a proximal end of the arms 16*a*, 16*b* to an underlying substrate 15 and being positioned or suspended over the substrate to be moveable in a plane above the substrate. Each arm including a latch couple portion 17*a*, 17*b* (which may take the form of a barb or protrusion) at its distal end that contacts and may be configured to operatively interconnect with corresponding receiving portions 19 (e.g., notches) in a shuttle portion 14 of the shuttle 30 to be latched. At a point along their span (e.g., at or about a point along their midspan), each outer latching arm 16*a*, 16*b* is connected by a corresponding connector or compliant beam, here embodied as compliant beam portions 20*a*, 20*b*, which may be integrally formed and may include portions that co-planar with the latching arms 16*a*, 16*b*.

In the illustrated embodiment, spring-loaded shuttle 30 is coupled to anchors 26*a*, 26*b* through spring mechanisms 27*a*, 27*b*. The latching action can be effectuated by firstly applying a force (generally designated 32) to a portion of an outer compliant beam (here shown including compliant beams 20*a*, 20*b*) to spread latch arms 16*a*, 16*b*. Secondly, a force (generally designated 31) may be applied to the shuttle portion 14 by a force-accepting member (e.g., a push-rod 25) associated with the shuttle 30. In the illustrated embodiment, the force on push-rod 25 can be employed to move shuttle 14 toward latch couples 17*a*, 17*b*, which can extend spring mechanisms 27*a* 27*b*. When shuttle portion 14 extends to a point where notches 19*a*, 19*b* line up or otherwise engage with latch couples 17*a*, 17*b*, the force 32 is removed from compliant beam 20*a*, 20*b*, thereby inserting or engaging latch couples 17*a*, 17*b* into notches 19*a*, 19*b* and latching shuttle portion 14. Contact portion or element 21 may be integral with a spring element 24 which may connect or attach to shuttle portion 14. Corresponding contact elements 28 may extend vertically from substrate 15. When shuttle portion 14 is latched in place, force 31 may be removed. When forces are removed and shuttle 14 latched by latch couple 17*a*, 17*b*, contact element 21 may span contacts 28 and the full force of spring element 24 can be applied to the switch contacts 28.

Electrical contact between contact element 21 and substrate contacts 28 may be enabled or facilitated, for example, by a metalization layer 23 provided on or in operative connection with contact element 21 and metalization layers 29 provided on or in operative connection with contact elements 28. The metalization layers can be formed on the sidewalls of the corresponding elements. An associated contact force may be provided by spring element 24. Moreover, the contact force can be adjusted by adjusting the size of the springs. Springs 27*a*, 27*b* may return shuttle 14 to its unlatched position when the latch arms 16*a*, 16*b* sufficiently open to provide for a release, permitting separation between the latch 20 and shuttle 30, and opening the switch contacts.

Any electrically energizable actuator suitable for the intended environment may apply the requisite forces. When high force is required such as the case when a high power switch is required, an ETC actuator may be preferred.

Figure 2:
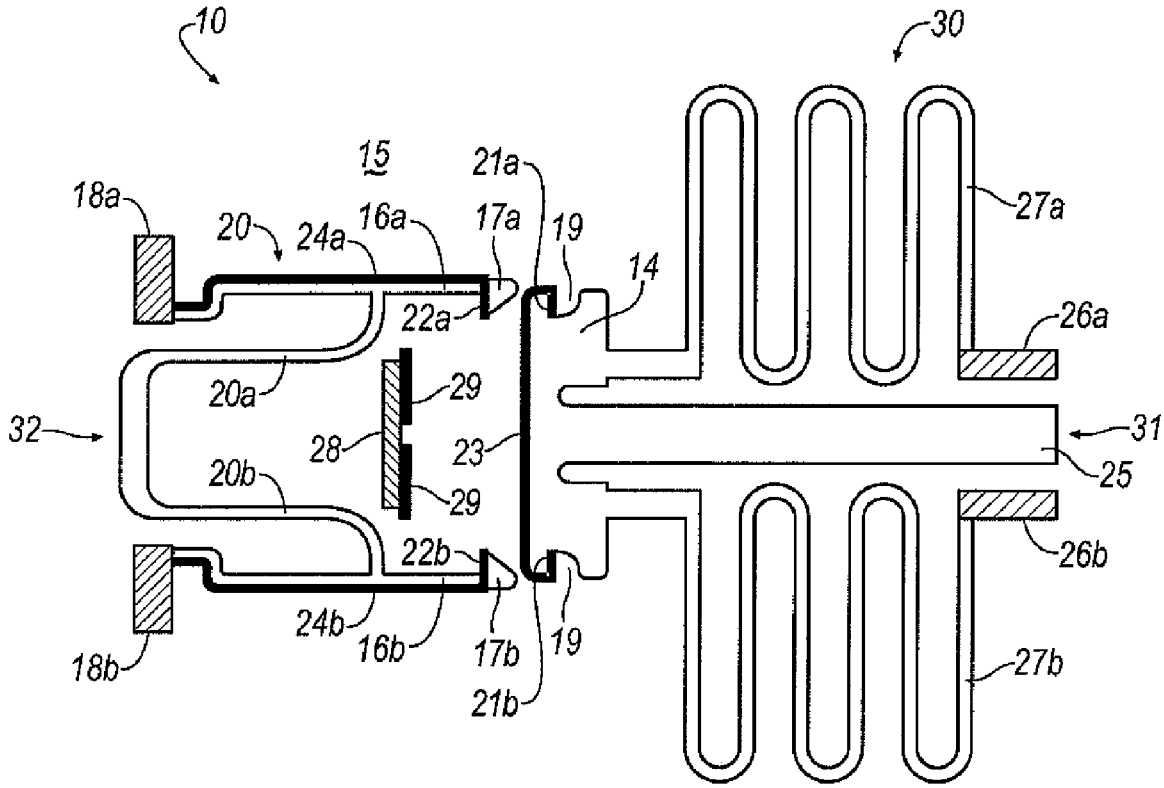
FIG. 2 shows a top-down view of a latching device in accordance with another embodiment of the invention.

FIG. 2. illustrates another embodiment of an embodiment of a MEMS switch 10 that also employs a planar fastener configuration. The illustrated embodiment includes many of the same elements and features, which are similarly numbered, but includes some modifications with respect to the contacting elements. Rather than including a spring element 24 of the type disclosed in connection with FIG. 1, a leading distal portion of shuttle portion 14 includes an operative electrical connecting material or layer (e.g., metallization layer 23).

The illustrated embodiment depicted in FIG. 2 generally shows an alternative means for making electrical contact between latch 20 and shuttle 30. By way of example, without limitation, latching arms 16*a*, 16*b* may include an operative electrical connecting material or layer (e.g., metallization layer portions generally designated 22*a*, 22*b*, 24*a*, 24*b*). With such an embodiment when the latch couples 17*a*, 17*b* move apart and then engage corresponding receiving portions 19 in shuttle 30, an electrical circuit may be formed. In the illustrated embodiment, the circuit may involve a potential electrical path comprising elements 24*a*, 22*a*, 21*a*, 23, 21*b*, 22*b*, 24*b*. It is noted that with such an embodiment, element 28 (and the corresponding contact/metalization layers 29) may, as desired, be included or eliminated from the device. If excluded, the electrical path may be as previously noted. If included, element 28 can provide a second or additional means for operative electrical contact with respect to the aforementioned intended circuit and/or layer 23 need not necessarily be continuous (as "gaps" in the length may be contacted by operative portions formed on element 28).

It is noted that the electrical connecting layer may, for some embodiments of the invention, may not be a layer per se that is placed upon an element. That is, for some embodiment, the electrical conducting layer may be provided by the composition of the element itself without requiring the inclusion of a separate electrically-conducting layer.

Further, various means of fabricating an actuator suitable for use in connection with embodiments of the invention are known in the art. For example, without limitation, the device may be fabricated using a multi-layer process.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A microelectromechanical (MEMS) switch comprising:

a substrate having an upper surface;

a force-activated latching mechanism having a proximal end and a distal end, the latching mechanism including two flexible latch arms each fixed at or about a proximal end and having a free distal end, the latching mechanism including a connector connecting the latch arms; and a spring-loaded shuttle having a proximal end and a distal end, the shuttle including a shuttle portion having a portion configured for engaging portions of the two flexible latch arms and an elongated force-accepting element comprising a push rod, the shuttle including a proximal portion connected to an anchor;

wherein the shuttle portion is configured to translate about the substrate, and the latching mechanism and the shuttle include an electrical contact layer configured such that when the latch arms are engaged with the shuttle portion, a closed electrical circuit is formed.

2. The switch of claim 1, wherein the latching mechanism includes a first electrically conducting portion having an electrical contact material or layer that is spaced from a second electrically conducting portion having an electrical contact material or layer.

3. The switch of claim 1, wherein the shuttle includes an electrical contacting portion or layer disposed on the shuttle portion.

4. The switch of claim 3, wherein the electrical contacting portion or layer of the shuttle is configured to movably contact both a first electrically conducting portion and a second electrically conducting portion of the latching mechanism, such that when the electrical contacting portion or layer of the shuttle is in contact with both the first and second electrically conducting portions of the latching mechanism, electrical current may flow from the first electrically conducting portion to the second electrical conducting portion.

5. The switch of claim 1, wherein the shuttle portion includes a spring element that includes an operative electrical conducting portion or layer.

6. The switch of claim 5, wherein the spring element comprises an arch of compliant material having a first end, a second end, and a center portion, the first and seconds ends being connected to the shuttle.

7. The switch of claim 1, wherein the shuttle includes a first spring mechanism and a second spring mechanism, the first and second spring mechanisms connected to the shuttle portion.

8. The switch of claim 7, wherein the proximal end of the latching mechanism and the proximal ends of the first and second spring mechanisms are connected to the upper surface of the substrate.

9. The switch of claim 1, wherein the force-accepting element of the shuttle is configured to translate with respect to the upper surface of the substrate.

10. The switch of claim 1, further wherein the distal end of the latching mechanism is configured to engage the shuttle portion to prevent translation of the shuttle.

11. The switch of claim 10, wherein the distal end of the latching mechanism includes at least one protruding element, and the shuttle portion includes at least one recess for receiving at least a portion of the protruding element.

12. The switch of claim 1, wherein the proximal ends of the latch arms are each connected to the substrate.

13. The switch of claim 1, wherein the shuttle portion includes a protruding element and at least one of the latch arms includes a portion to receive the protruding element of the shuttle portion.

14. The switch of claim 1, wherein the electrical contacting layer or material of the shuttle portion, so as to complete a circuit when the shuttle is latched to the latching mechanism, is selectively disposed on a center portion of the shuttle portion.

15. The switch of claim 1, wherein the shuttle has a tensioned state and a relaxed state.

16. The switch of claim 15, wherein the electrical contacting material or layer of the shuttle portion is not in operative electrical contact with the latching mechanism when the shuttle is in the relaxed state.

17. A microelectromechanical (MEMS) switch comprising:

a substrate having an upper surface;

a force-activated latching mechanism having a proximal end and a distal end, the latching mechanism including two flexible latch arms each fixed at or about a proximal end and having a free distal end, the latching mechanism including a means for connecting the latch arms; and a spring-loaded shuttle having a proximal end and a distal end, the shuttle including means for engaging portions of the two flexible latch arms and an elongated force-accepting element comprising a push rod;

wherein the shuttle portion is configured to translate about the substrate, and the latching mechanism and the shuttle include a means for forming a closed electrical circuit when the latch arms are engaged with the means for engaging portions of the two latch arms.

* * * * *